US010046567B2

(12) United States Patent
Le et al.

(10) Patent No.: US 10,046,567 B2
(45) Date of Patent: Aug. 14, 2018

(54) PRINTER WITH PARTICLE DIVERTING

(71) Applicant: HEWLETT-PACKARD DEVELOPMENT COMPANY, L.P., Houston, TX (US)

(72) Inventors: Huy Le, Vancouver, WA (US); James D. Plymale, Vancouver, WA (US); Michael Lee Hilton, Vancouver, WA (US)

(73) Assignee: Heweltt-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/547,801

(22) PCT Filed: Apr. 30, 2015

(86) PCT No.: PCT/US2015/028521

§ 371 (c)(1),
(2) Date: Jul. 31, 2017

(87) PCT Pub. No.: WO2016/175833

PCT Pub. Date: Nov. 3, 2016

(65) Prior Publication Data

US 2018/0022100 A1 Jan. 25, 2018

(51) Int. Cl.

| | |
|---|---|
| ***B41J 2/17*** | (2006.01) |
| ***B41J 29/17*** | (2006.01) |
| ***B41J 11/00*** | (2006.01) |

(52) U.S. Cl.

CPC ..... *B41J 2/1714* (2013.01); *B41J 11/0015* (2013.01); *B41J 29/17* (2013.01)

(58) Field of Classification Search

CPC ..... B41J 11/00; B41J 11/0005; B41J 11/001; B41J 11/0015; B41J 11/0025; B41J 11/003; B41J 11/0035; B41J 11/004; B41J 11/0045; B41J 11/005; B41J 11/0055; B41J 11/006; B41J 11/007; B41J 11/38; B41J 11/22; B41J 11/42

See application file for complete search history.

(56) References Cited

U.S. PATENT DOCUMENTS

| | | | |
|---|---|---|---|
| 6,318,838 | B1 | 11/2001 | Anderson et al. |
| 6,328,442 | B1 | 12/2001 | Brinkly |
| 6,561,621 | B2 | 5/2003 | Webster et al. |
| 7,824,008 | B2 | 11/2010 | Barger et al. |
| 8,764,164 | B1 | 7/2014 | Anderson |
| 2006/0023021 | A1 | 2/2006 | Shimizu |
| 2009/0066976 | A1 | 3/2009 | Uchida et al. |
| 2012/0218347 | A1 | 8/2012 | Itogawa |

(Continued)

FOREIGN PATENT DOCUMENTS

| | | |
|---|---|---|
| CN | 202186134 | 4/2012 |

OTHER PUBLICATIONS

Bohórquez, Jaime H. et al., "Laser-Comparable Inkjet Text Printing", Hewlett-Packard Journal, Feb. 1994, 9 pgs.

*Primary Examiner* — Kristal Feggins
(74) *Attorney, Agent, or Firm* — Dicke, Billig & Czaja PLLC

(57) ABSTRACT

A printer includes a print media transport to transport a print media through a print zone, the transport of the print media to produce airborne particles, and a particle diverter to divert the airborne particles away from the print zone from a vicinity of the print media transport.

19 Claims, 8 Drawing Sheets

(56) References Cited

U.S. PATENT DOCUMENTS

| | | | | |
|---|---|---|---|---|
| 2012/0236497 | A1 | 9/2012 | Watts et al. | |
| 2014/0002542 | A1 * | 1/2014 | Chino | B41J 2/16535 347/33 |

* cited by examiner

PRINTER WITH PARTICLE DIVERTING

BACKGROUND

A printer may include a print media transport to move and/or route print media through the printer. Routing of the print media through the printer may produce airborne particles which may contribute to print defects and/or printer malfunction.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
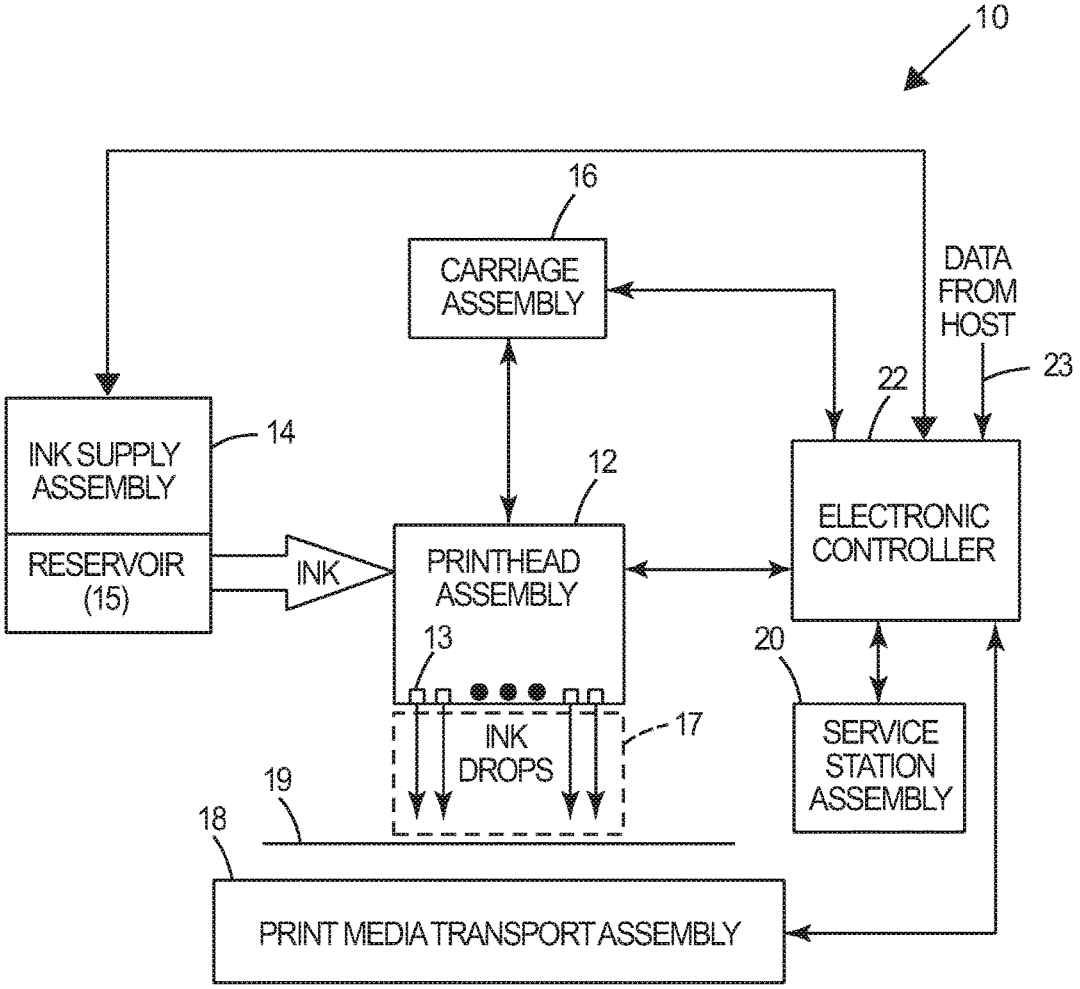
FIG. 1 is a block diagram illustrating one example of an inkjet printing system.

FIG. 1 illustrates one example of an inkjet printing system 10. Inkjet printing system 10 includes a fluid ejection assembly, such as printhead assembly 12, and a fluid supply assembly, such as ink supply assembly 14. In the illustrated example, inkjet printing system 10 also includes a carriage assembly 16, a print media transport assembly 18, a service station assembly 20, and an electronic controller 22.

Printhead assembly 12 includes one or more printheads or fluid ejection devices which eject drops of ink or fluid through a plurality of orifices or nozzles 13. In one example, the drops are directed toward a medium, such as print media 19, so as to print onto print media 19. Print media 19 includes any type of suitable sheet material, such as paper, card stock, transparencies, Mylar, fabric, and the like. Typically, nozzles 13 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, in one example, ink flows from reservoir 15 to printhead assembly 12. In one example, printhead assembly 12 and ink supply assembly 14 are housed together in an inkjet or fluid-jet print cartridge or pen. In another example, ink supply assembly 14 is separate from printhead assembly 12 and supplies ink to printhead assembly 12 through an interface connection, such as a supply tube.

Carriage assembly 16 positions printhead assembly 12 relative to print media transport assembly 18 and print media transport assembly 18 positions print media 19 relative to printhead assembly 12. Thus, a print zone 17 is defined adjacent to nozzles 13 in an area between printhead assembly 12 and print media 19. In one example, printhead assembly 12 is a scanning type printhead assembly such that carriage assembly 16 moves printhead assembly 12 relative to print media transport assembly 18. In another example, printhead assembly 12 is a non-scanning type printhead assembly such that carriage assembly 16 fixes printhead assembly 12 at a prescribed position relative to print media transport assembly 18.

Service station assembly 20 provides for spitting, wiping, capping, and/or priming of printhead assembly 12 in order to maintain a functionality of printhead assembly 12 and, more specifically, nozzles 13. For example, service station assembly 20 may include a rubber blade or wiper which is periodically passed over printhead assembly 12 to wipe and clean nozzles 13 of excess ink. In addition, service station assembly 20 may include a cap which covers printhead assembly 12 to protect nozzles 13 from drying out during periods of non-use. In addition, service station assembly 20 may include a spittoon into which printhead assembly 12 ejects ink to insure that reservoir 15 maintains an appropriate level of pressure and fluidity, and insure that nozzles 13 do not clog or weep. Functions of service station assembly 20 may include relative motion between service station assembly 20 and printhead assembly 12.

Electronic controller 22 communicates with printhead assembly 12, carriage assembly 16, print media transport assembly 18, and service station assembly 20. Thus, in one example, when printhead assembly 12 is mounted in carriage assembly 16, electronic controller 22 and printhead assembly 12 communicate via carriage assembly 16. Electronic controller 22 also communicates with ink supply assembly 14 such that, in one implementation, a new (or used) ink supply may be detected, and a level of ink in the ink supply may be detected.

Electronic controller 22 receives data 23 from a host system, such as a computer, and may include memory for temporarily storing data 23. Data 23 may be sent to inkjet printing system 10 along an electronic, infrared, optical or other information transfer path. Data 23 represents, for example, a document and/or file to be printed. As such, data 23 forms a print job for inkjet printing system 10 and includes one or more print job commands and/or command parameters.

In one example, electronic controller 22 provides control of printhead assembly 12 including timing control for ejection of ink drops from nozzles 13. As such, electronic controller 22 defines a pattern of ejected ink drops which form characters, symbols, and/or other graphics or images on print media 19. Timing control and, therefore, the pattern of ejected ink drops, is determined by the print job commands and/or command parameters. In one example, logic and drive circuitry forming a portion of electronic controller 22 is located on printhead assembly 12. In another example, logic and drive circuitry forming a portion of electronic controller 22 is located off printhead assembly 12.

Figure 2:
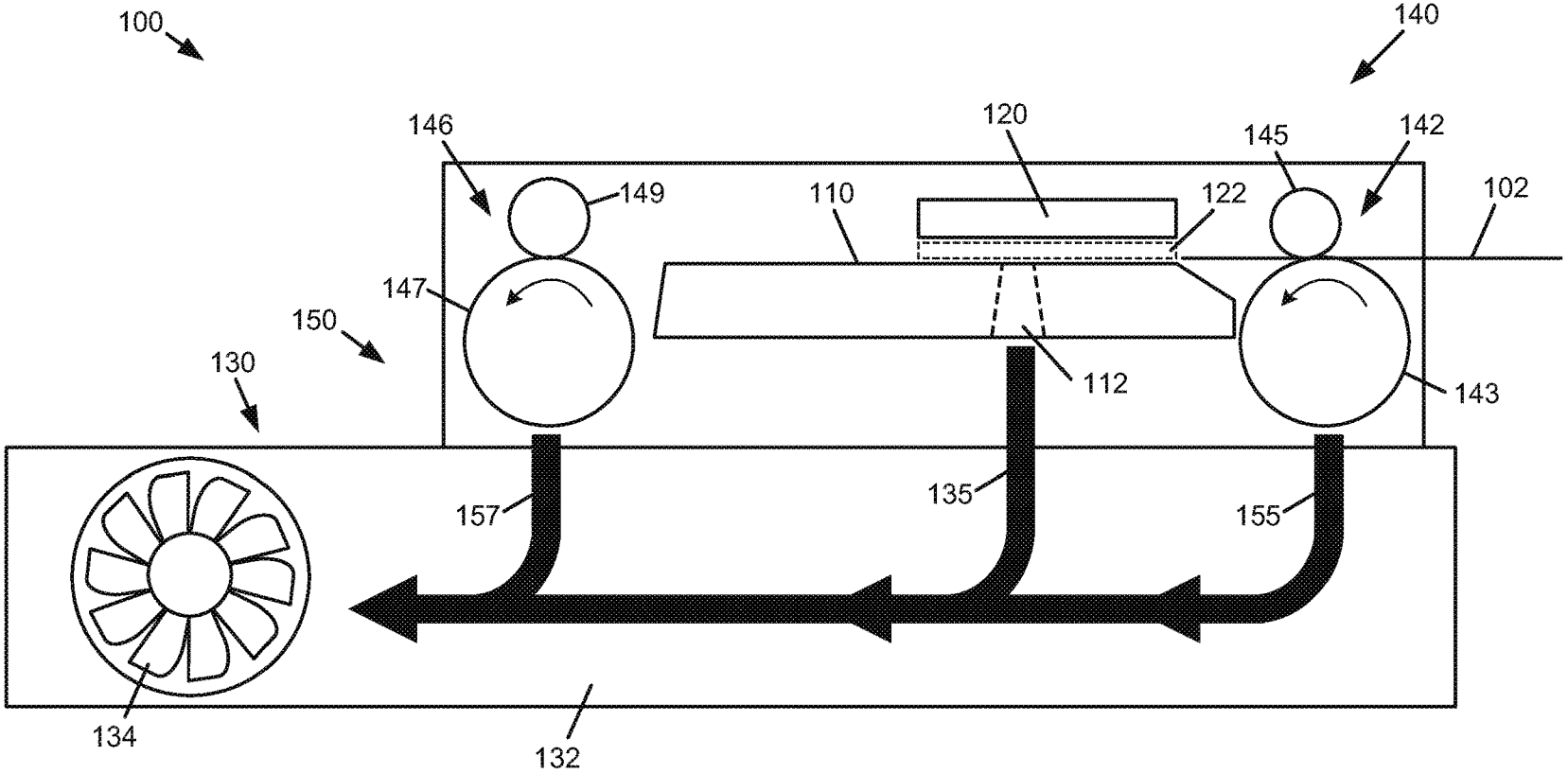
FIG. 2 is a schematic illustration of one example of a portion of a printer.

FIG. 2 is a schematic illustration of one example of a portion of a printer 100. In one implementation, printer 100 includes a platen 110 to support a print media 102, as an example of print media 19, and includes a print engine 120 to print on print media 102. In addition, in one implementation, printer 100 includes a waste ink collection system 130, as an example of a portion of service station assembly 20, and includes a print media transport 140, as an example of a portion of print media transport assembly 18.

Print engine 120 can be a laser print engine, an inkjet print engine, or any other type of print engine. In one implementation, a print area or print zone 122 is defined in which printing on print media 102 by print engine 120 occurs. In one example, printer 100 is implemented as an inkjet printing system, such as inkjet printing system 10, and print engine 120 includes, for example, printhead assembly 12. When print engine 120 is implemented as an example of printhead assembly 12, print zone 122 includes print zone 17 as defined between printhead assembly 12 and print media 19 (FIG. 1).

In one example, waste ink collection system 130 includes a spittoon 132 into which printhead assembly 12, as an example of print engine 120, ejects ink to insure that an associated reservoir, such as reservoir 15, maintains an appropriate level of pressure and fluidity, and to insure that associated nozzles, such as nozzles 13, do not clog or weep. In one implementation, an opening 112 is formed through platen 110 such that printhead assembly 12, as an example of print engine 120, ejects ink into spittoon 132 through opening 112 and, therefore, through platen 110.

In one example, waste ink collection system 130 includes an airflow source, such as a fan 134, to draw ink aerosol away from print zone 122 to help prevent ink aerosol from spreading throughout printer 100. Ink aerosol includes, for example, a mist or fog of suspended ink droplets resulting from operation of printhead assembly 12, as an example of print engine 120. In one implementation, fan 134 generates a vacuum, partial vacuum or zone of reduced pressure within printer 100 to draw air, including ink aerosol, from print zone 122 through opening 112 in platen 110, as represented by arrow 135.

Print media transport 140 may include a variety of guides, rollers, wheels, etc. for the handling and/or routing of print media 102 through printer 100. In one example, print media transport 140 includes a feed roller assembly 142 and an output roller assembly 146. As such, feed roller assembly 142 transports, guides, and/or directs print media 102 to print zone 122, and output roller assembly 146 transports, guides, and/or directs print media 102 away from print zone 122. In one implementation, feed roller assembly 142 includes a feed roller 143 and a pinch roller 145. In one example, feed roller 143 is rotatably mounted for rotation and driven in the direction indicated, and pinch roller 145 is mounted in an opposing relationship to feed roller 143 such that a nip is formed between feed roller 143 and pinch roller 145. In one implementation, output roller assembly 146 includes an output roller 147 and a roller or starwheel 149. In one example, output roller 147 is mounted for rotation and driven in the direction indicated, and starwheel 149 is mounted in an opposing relationship to output roller 147 such that starwheel 149 is in contact with output roller 147.

In one implementation, printer 100 includes a particle diverter 150 to divert particles present or generated by and/or within printer 100. For example, operation of print media transport 140 may generate or produce particles within printer 100 during the transport of print media 102 through and/or within printer 100. More specifically, operation of feed roller assembly 142 and/or operation of output roller assembly 146 may generate or produce particles within printer 100. The particles may include fibrous particles of print media 102 and/or other dust particles present or generated by and/or within printer 100. In one example, the particles are suspended in air within printer 100 so as to form airborne particles, including airborne fibrous particles or dust laden air.

Accordingly, and as further described below, particle diverter 150 helps to prevent particles from settling or collecting on components of printer 100. For example, particle diverter 150 diverts or draws particles away from print zone 122 so as to help prevent particles from settling or collecting on components within printer 100 including, for example, settling or collecting on print engine 120. For example, with printhead assembly 12 representing an example of print engine 120, particle diverter 150 helps to prevent particles from settling or collecting on a face or surface of printhead assembly 12 in which nozzles 13 are formed. Such particles, for example, may potentially block (wholly or partially) nozzles 13 and, therefore, may cause degradation or malfunction of nozzles 13 thereby resulting in print defects and/or printer malfunction.

In one example, particle diverter 150 diverts or draws particles from an input or upstream side of platen 110, and diverts or draws particles from an output or downstream side of platen 110. In one example, and as further described below, particle diverter 150 diverts or draws particles from areas of printer 100 where particles may be generated. In one implementation, particle diverter 150 diverts or draws particles from an area or areas of printer 100 which include components of print media transport 140 including, for example, a region or regions adjacent or in a vicinity of print media transport 140. In one example, particle diverter 150 diverts or draws particles from areas of feed roller assembly 142 and/or output roller assembly 146, as represented by arrows 155 and 157.

In one implementation, particle diverter 150 includes an airflow source to divert or draw particles away from print zone 122. In one example, the airflow source includes fan 134, as also used to draw ink aerosol away from print zone 122.

Figure 2A:
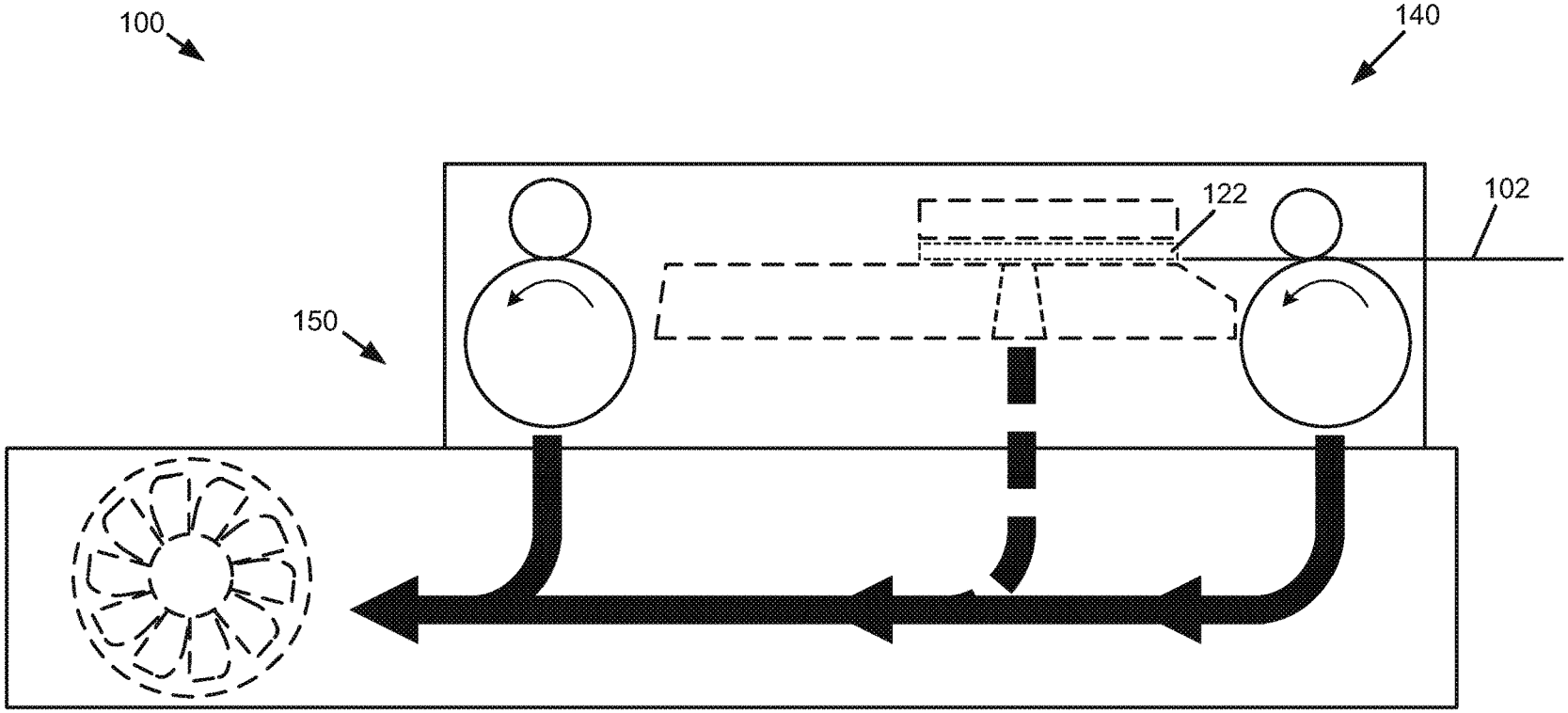
FIG. 2A is a schematic illustration of one example of a portion of the printer of FIG. 2.

FIG. 2A is a schematic illustration of one example of a portion of printer 100 including print media transport 140 to transport print media 102 through print zone 122, and particle diverter 150 to divert airborne particles away from print zone 122 from a vicinity of print media transport 140.

Figure 3:
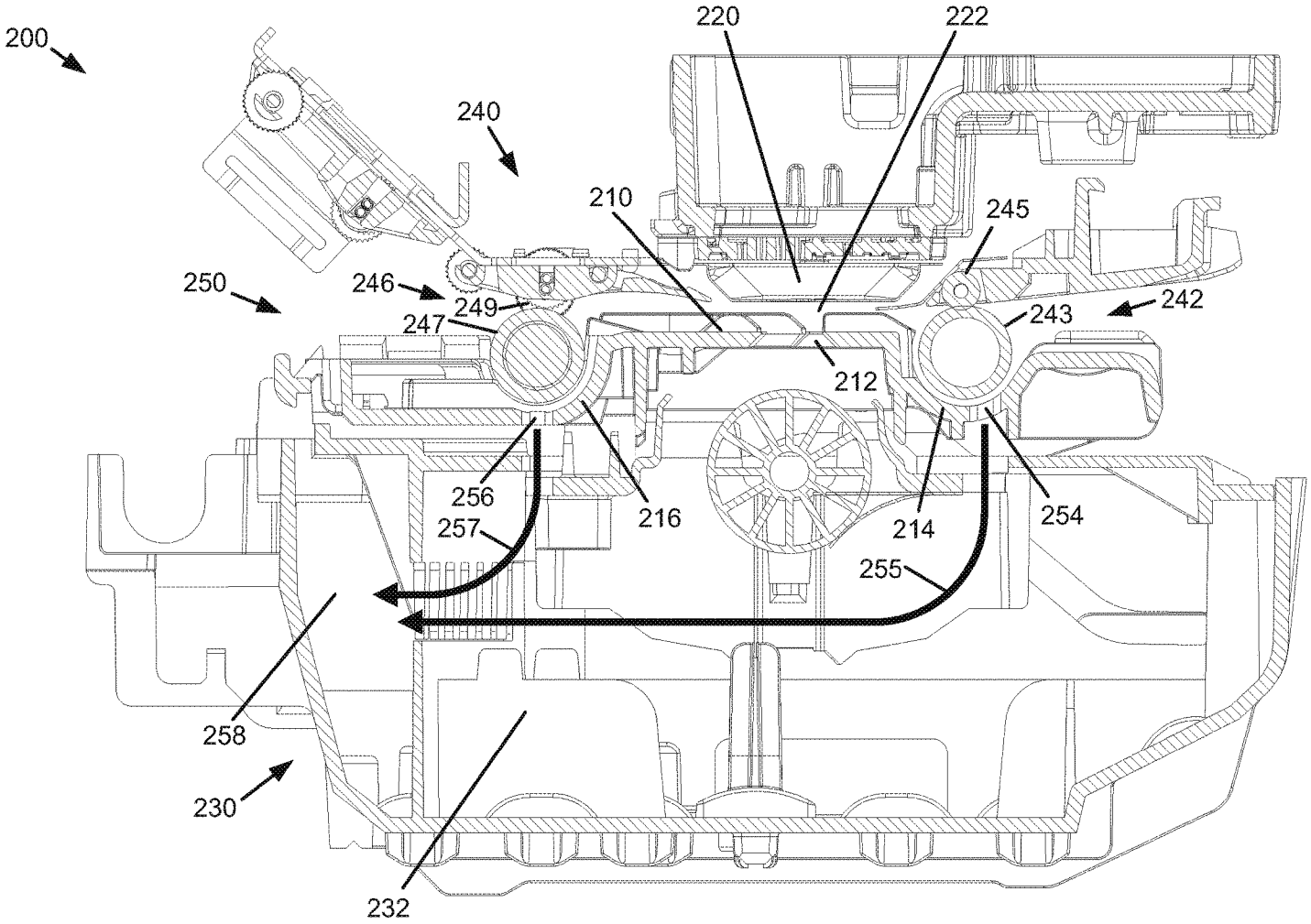
FIG. 3 is a cross-sectional view illustrating one example of a portion of a printer.

FIG. 3 is a cross-sectional view illustrating one example of a portion of a printer 200. In one implementation, printer 200 includes a platen 210 to support a print media, such as print media 19 (FIG. 1), and includes a print engine 220, such as printhead assembly 12 (FIG. 1), to print on the print media, with a print zone 222 defined between print engine 220 and platen 210. In addition, in one implementation, printer 200 includes a waste ink collection system 230, as an example of waste ink collection system 130 (FIG. 2), and includes a print media transport 240, as an example of print media transport 140 (FIG. 2). Furthermore, printer 200 includes a particle diverter 250, as an example of particle diverter 150 (FIG. 2).

In one implementation, waste ink collection system 230 includes a spittoon 232, as an example of spittoon 132 (FIG. 2), and an opening 212, as an example of opening 112 (FIG. 2), is formed or defined through platen 210. As such, printhead assembly 12, as an example of print engine 220, ejects ink through opening 212 and, therefore, through platen 210 into spittoon 232 for servicing of printhead assembly 12.

In one example, print media transport 240 includes a feed roller assembly 242, with a feed roller 243 and an opposing pinch roller 245, and includes an output roller assembly 246, with an output roller 247 and an opposing roller or starwheel 249. As such, in one implementation, particle diverter 250 includes a passage, slot, or other type of opening formed or defined through platen 210 (or a portion extending from or supporting platen 210) in a region or regions adjacent or in a vicinity of feed roller assembly 242 and output roller assembly 246. For example, in one implementation, particle diverter 250 includes an opening 254 formed through platen 210 in a vicinity of feed roller assembly 242, and includes an opening 256 formed through platen 210 in a vicinity of output roller assembly 246.

In one example, platen 210 (or a portion extending from or supporting platen 210) includes a recessed area or areas to accommodate print media transport 240. For example, in one implementation, platen 210 includes a recessed area 214 to accommodate feed roller assembly 242 and includes a recessed area 216 to accommodate output roller assembly 246 such that, in one example, feed roller 243 rotates within recessed area 214 and output roller 247 rotates within recessed area 216. As such, in one implementation, opening 254 is formed through platen 210 within recessed area 214, and opening 256 is formed through platen 210 within recessed area 216. Accordingly, particle diverter 250 diverts or draws particles from an input or upstream side of platen 210 through opening 254, and diverts or draws particles from an output or downstream side of platen 210 through opening 256.

In one implementation, particle diverter 250 includes an airflow duct 258 and an airflow source, such as fan 134 (FIG. 2), communicated with airflow duct 258 such that the airflow source draws air and particles, including, for example, airborne particles, from an area or areas of print media transport 240 into airflow duct 258. For example, the airflow source draws air and particles from a region adjacent or in a vicinity of feed roller assembly 242 through opening 254 and into airflow duct 258, as represented by arrow 255, and draws air and particles from a region adjacent or in a vicinity of output roller assembly 246 through opening 256 and into airflow duct 258, as represented by arrow 257.

Figure 4:
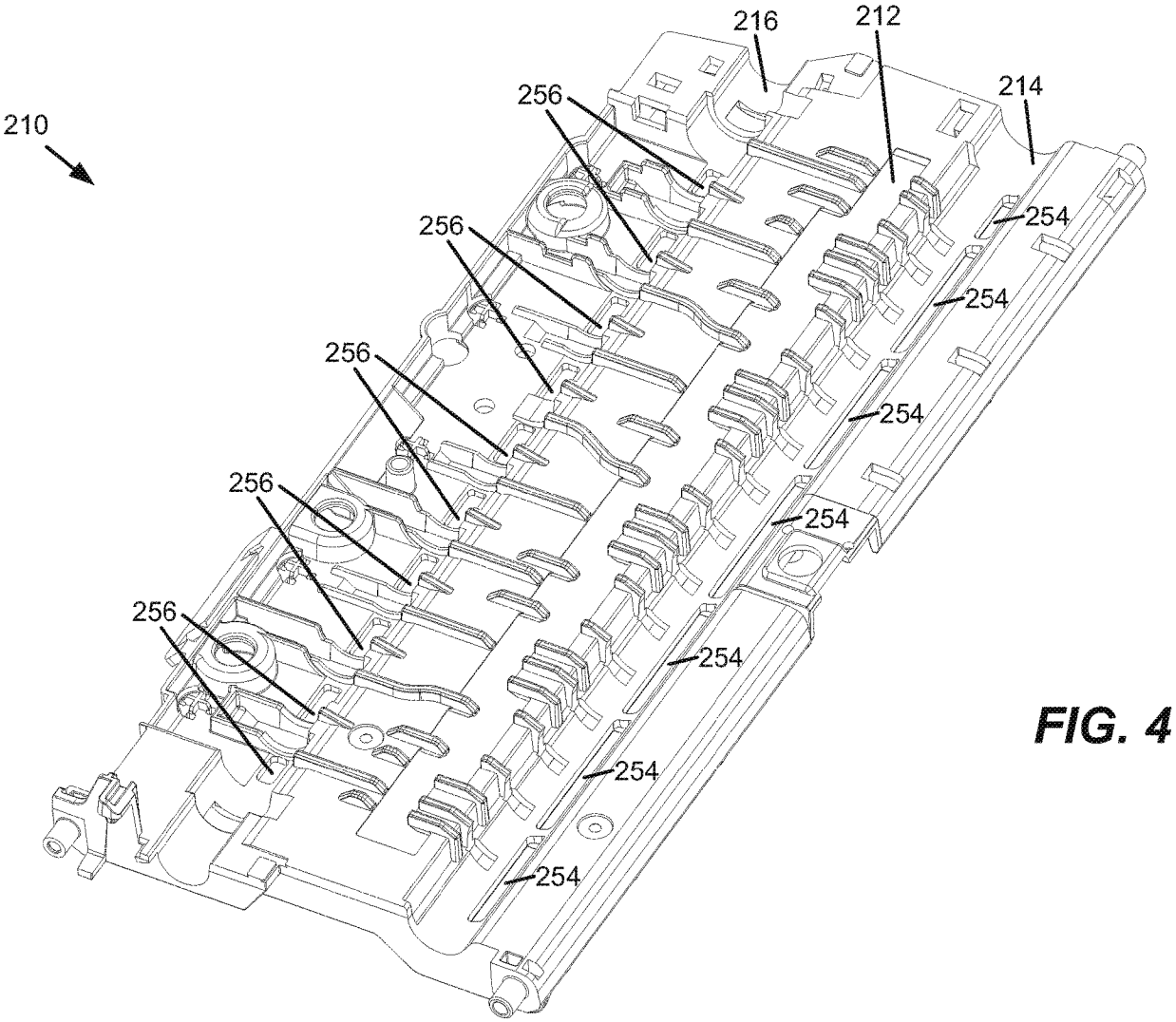
FIG. 4 is a perspective view illustrating one example of a platen of the printer of FIG. 3.

FIG. 4 is a perspective view illustrating one example of platen 210. In one example, as described above, platen 210 includes opening 212 for waste ink collection system 230, and openings 254 and 256 for particle diverter 250. In one implementation, as illustrated in FIG. 4, opening 254 includes a plurality of individual openings 254, and opening 256 includes a plurality of individual openings 256. It is understood, however, that openings 254 and 256 may each include any number of openings, including one opening or more than one opening.

Figure 5:
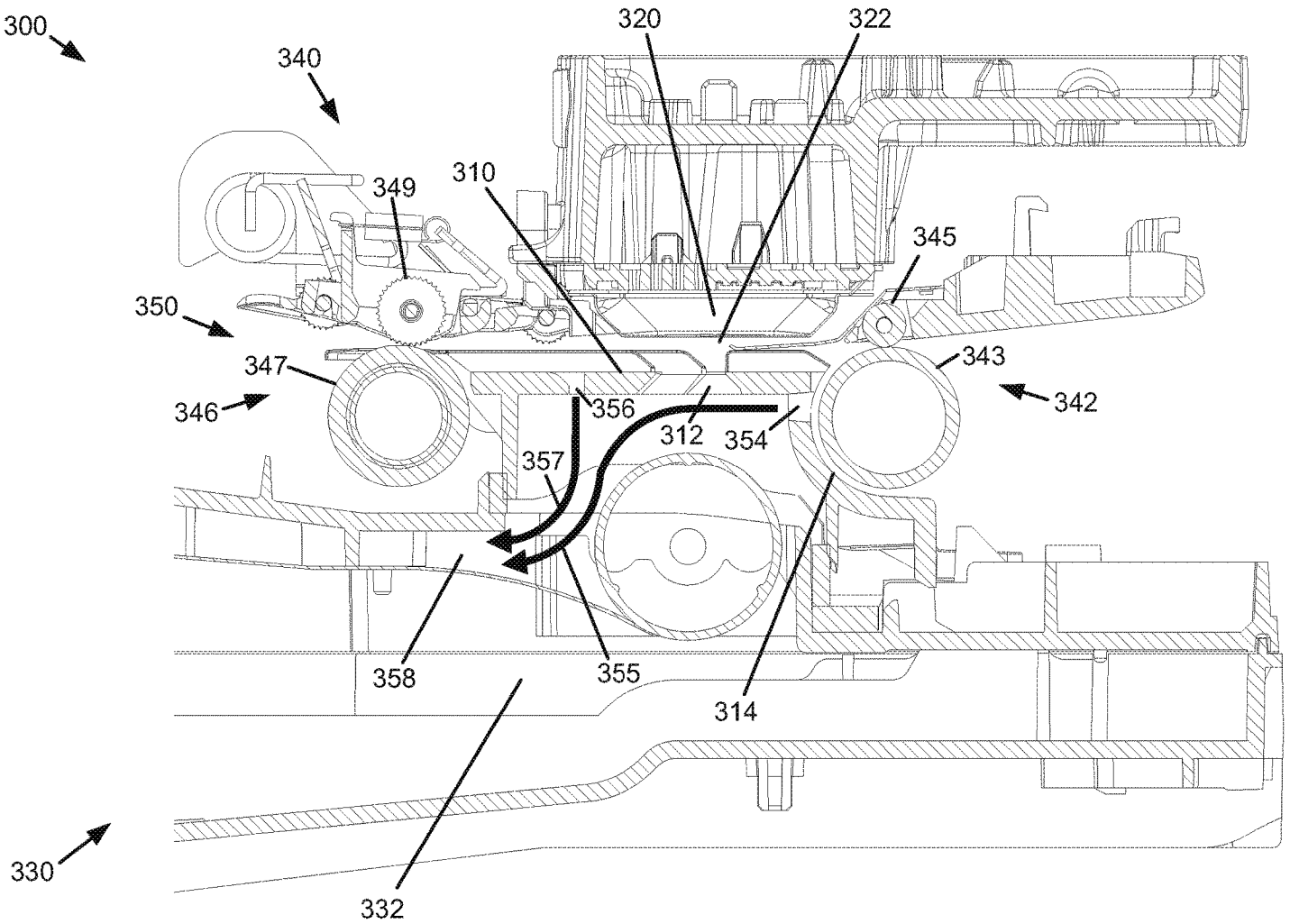
FIG. 5 is a schematic view illustrating another example of a portion of a printer.

FIG. 5 is a cross-sectional view illustrating another example of a portion of a printer 300. In one implementation, printer 300 includes a platen 310 to support a print media, such as print media 19 (FIG. 1), and includes a print engine 320, such as printhead assembly 12 (FIG. 1), to print on the print media, with a print zone 322 defined between print engine 320 and platen 310. In addition, in one implementation, printer 300 includes a waste ink collection system 330, as an example of waste ink collection system 130 (FIG. 2), and includes a print media transport 340, as an example of print media transport 140 (FIG. 2). Furthermore, printer 300 includes a particle diverter 350, as an example of particle diverter 150 (FIG. 2).

In one implementation, waste ink collection system 330 includes a spittoon 332, as an example of spittoon 132 (FIG. 2), and an opening 312, as an example of opening 112 (FIG. 2), is formed or defined through platen 310. As such, printhead assembly 12, as an example of print engine 320, ejects ink through opening 312 and, therefore, through platen 310 into spittoon 332 for servicing of printhead assembly 12.

In one example, print media transport 340 includes a feed roller assembly 342, with a feed roller 343 and an opposing pinch roller 345, and includes an output roller assembly 346, with an output roller 347 and an opposing roller or starwheel 349. As such, in one implementation, particle diverter 350 includes a passage, slot, or other type of opening formed or defined through platen 310 (or a portion extending from or supporting platen 310) in a region or regions adjacent or in a vicinity of feed roller assembly 342 and output roller assembly 346. For example, in one implementation, particle diverter 350 includes an opening 354 formed through platen 310 in a vicinity of feed roller assembly 342, and includes an opening 356 formed through platen 310 in a vicinity of output roller assembly 346.

In one implementation, platen 310 (or a portion extending from or supporting platen 310) includes a recessed area or areas to accommodate print media transport 340. For example, platen 310 includes a recessed area 314 to accommodate feed roller assembly 342 such that, in one implementation, feed roller 343 rotates within recessed area 314 of platen 310. As such, in one implementation, opening 354 is formed through platen 310 within recessed area 314. In addition, in one implementation, opening 356 is formed through platen 310 in a vicinity of output roller assembly 346. Accordingly, particle diverter 350 diverts or draws particles from an input or upstream side of platen 310 through opening 354, and diverts or draws particles from an output or downstream side of platen 310 through opening 356.

In one implementation, particle diverter 350 includes an airflow duct 358 and an airflow source, such as fan 134 (FIG. 2), communicated with airflow duct 358 such that the airflow source draws air and particles, including, for example, airborne particles, from an area or areas of print media transport 340 into airflow duct 358. For example, the airflow source draws air and particles from a region adjacent or in a vicinity of feed roller assembly 342 through opening 354 and into airflow duct 358, as represented by arrow 355, and draws air and particles from a region adjacent or in a vicinity of output roller assembly 346 through opening 356 and into airflow duct 358, as represented by arrow 357.

Figure 7:
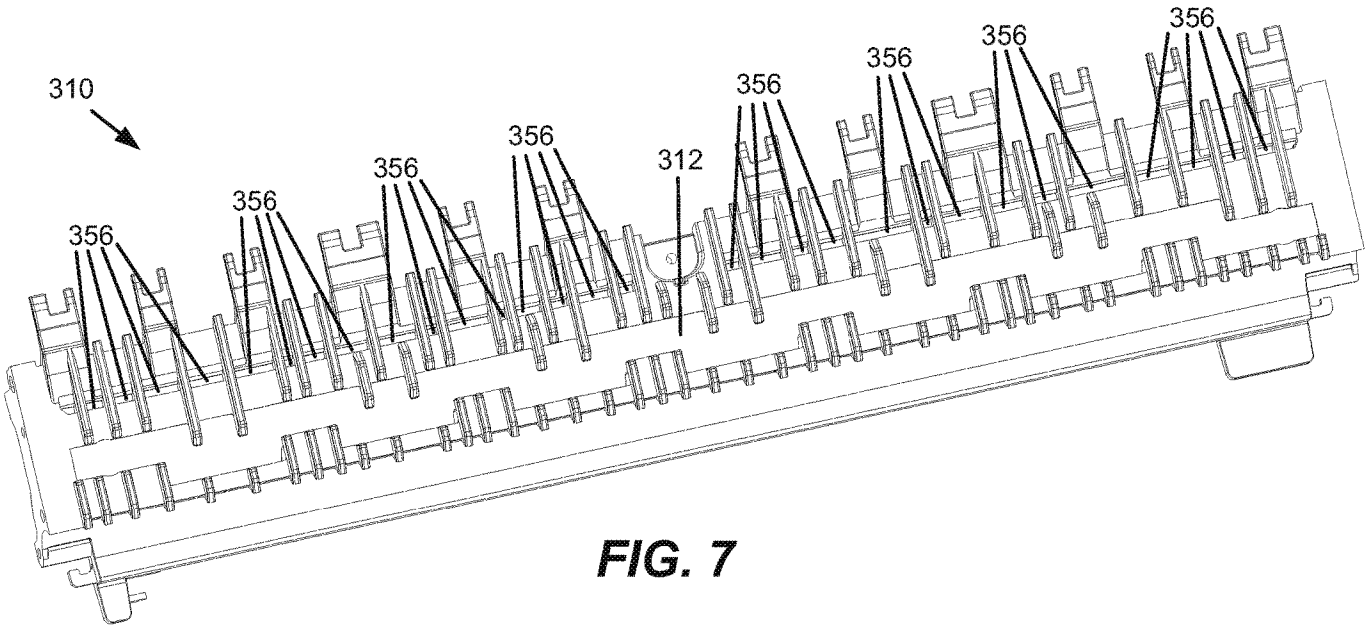
FIGS. 6 and 7 are perspective views illustrating one example of a platen of the printer of FIG. 5.
Figure 6:
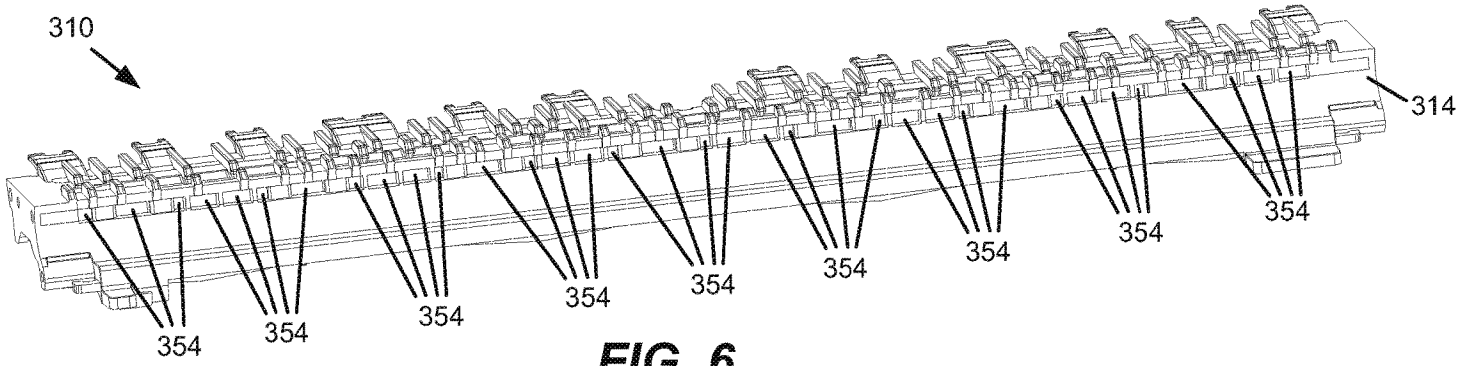

FIGS. 6 and 7 are perspective views illustrating one example of platen 310. In one example, as described above, platen 310 includes opening 312 for waste ink collection system 330, and openings 354 and 356 for particle diverter 350. In one implementation, as illustrated in FIG. 4, opening 354 includes a plurality of individual openings 354, and opening 356 includes a plurality of individual openings 356. It is understood, however, that openings 354 and 356 may each include any number of openings, including one opening or more than one opening.

Figure 8:
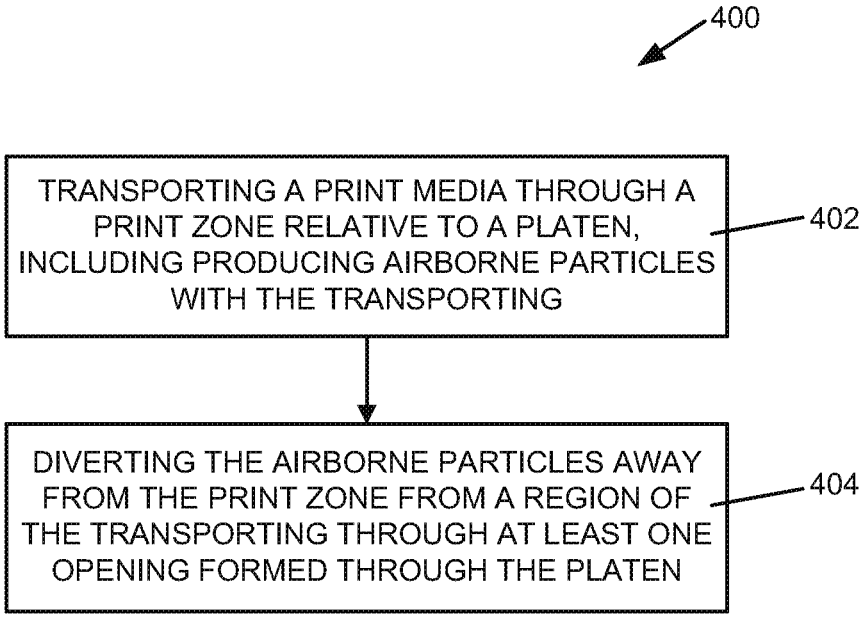
FIG. 8 is a flow diagram illustrating one example of a method of printing.

FIG. 8 is a flow diagram illustrating one example of a method 400 of printing with a printer, such as printer 100, including a particle diverter, such as particle diverter 150, as schematically illustrated in the example of FIG. 2.

With method 400, at 402, print media, such as print media 102, is transported through a print zone relative to a platen, such as print zone 122 and platen 110, as schematically illustrated in the example of FIG. 2. In one example, with the transporting of the print media, airborne particles are produced or generated.

As such, at 404, the airborne particles are diverted from the print zone from a region of the transporting through at least one opening formed through the platen. For example, as schematically illustrated in the example of FIG. 2, airborne particles are diverted or drawn away from an area or areas of the printer which include components of a print media transport, such as print media transport 140, including, for example, a region or regions adjacent or in a vicinity of the print media transport. More specifically, as illustrated in the examples of FIGS. 3 and 5, airborne particles are diverted or drawn through openings 254 and/or 256 and openings 354 and/or 356 formed through platens 210 and 310, respectively. As such, the airborne particles are diverted or drawn away from the print zone so as to help prevent the particles from settling or collecting on components within the printer including, for example, print engine 120.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. A printer, comprising:

a platen to support a print media in a print zone;

a print media transport to transport the print media through the print zone, the transport of the print media to produce airborne particles; and a particle diverter to divert the airborne particles away from the print zone from a vicinity of the print media transport, the print media transport positioned within a recessed area of the platen, and the particle diverter to divert the airborne particles through the platen in the recessed area of the platen.

2. The printer of claim 1, further comprising:

the platen having at least one diverter passage formed therethrough in the recessed area, and the particle diverter to divert the airborne particles through the diverter passage in the recessed area of the platen.

3. The printer of claim 2, wherein the particle diverter includes an airflow source to draw the airborne particles through the diverter passage and away from the print zone.

4. The printer of claim 1, wherein the print media transport including at least one of a feed roller assembly within the recessed area of the platen at an upstream side of the print zone and an output roller assembly within the recessed area of the platen at a downstream side of the print zone, the particle diverter to divert the airborne particles away from the print zone through the platen in the recessed area of the platen from a vicinity of the at least one of the feed roller assembly and the output roller assembly.

5. The printer of claim 1, wherein the print media transport including a roller to rotate within the recessed area of the platen, the particle diverter to divert the airborne particles from a vicinity of the roller through the platen in the recessed area of the platen.

6. The printer of claim 1, further comprising:

the particle diverter to draw air through the platen within the print zone.

7. A printer, comprising:

a print engine to print on a print media supported by a platen within a print zone;

a print media transport to transport the print media through the print zone, the transport of the print media to generate airborne particles; and at least one opening formed through the platen through which to direct the airborne particles away from the print zone from an area adjacent the print media transport, wherein the platen includes a recessed area, wherein the print media transport is positioned within the recessed area of the platen, wherein the at least one opening is formed through the platen in the recessed area.

8. The printer of claim 7, wherein the print media transport includes a roller, wherein the roller is to rotate within the recessed area of the platen, wherein the at least one opening is formed through the platen in the recessed area adjacent the roller.

9. The printer of claim 7, wherein the print media transport includes a feed roller assembly at an input side of the platen, wherein the recessed area is at the input side of the platen, wherein a roller of the feed roller assembly is to rotate within the recessed area of the platen, wherein the at least one opening is formed through the platen in the recessed area adjacent the roller of the feed roller assembly.

10. The printer of claim 7, wherein the print media transport includes an output roller assembly at an output side of the platen, wherein the recessed area is at the output side of the platen, wherein a roller of the output roller assembly is to rotate within the recessed area of the platen, wherein the at least one opening is formed through the platen in the recessed area adjacent the roller of the output roller assembly.

11. The printer of claim 7, further comprising:

an airflow duct communicated with the at least one opening; and an airflow source communicated with the airflow duct, wherein the airborne particles are to be drawn through the at least one opening and through the airflow duct by the airflow source.

12. The printer of claim 7, further comprising:

an additional opening formed through the platen within the print zone to facilitate servicing of the print engine.

13. The printer of claim 7, further comprising:

an additional opening formed through the platen within the print zone to draw air therethrough from the print zone.

14. A method of printing, comprising:

transporting a print media through a print zone relative to a platen, including rotating a roller assembly within a recessed area of the platen and producing airborne particles with the transporting; and diverting the airborne particles away from the print zone from a region of the transporting, including diverting the airborne particles through at least one opening formed through the platen in the recessed area adjacent the roller assembly.

15. The method of claim 14, wherein transporting the print media includes rotating a roller of a feed roller assembly within the recessed area of the platen, and wherein diverting the airborne particles includes diverting the airborne particles through the at least one opening formed through the platen in the recessed area adjacent the roller of the feed roller assembly.

16. The method of claim 14, wherein transporting the print media includes rotating a roller of an output roller assembly within the recessed area of the platen, and wherein diverting the airborne particles includes diverting the airborne particles through the at least one opening formed through the platen in the recessed area adjacent the roller of the output roller assembly.

17. The method of claim 14, wherein diverting the airborne particles includes drawing the airborne particles through the at least one opening formed through the platen in the recessed area.

18. The method of claim 14, wherein diverting the airborne particles includes diverting the airborne particles from at least one of an upstream side of the print zone and a downstream side of the print zone.

19. The method of claim 14, further comprising:

drawing air from the print zone through an additional opening formed through the platen within the print zone.

* * * * *